US005927226A

United States Patent [19]

Patterson

[11] Patent Number: 5,927,226

[45] Date of Patent: Jul. 27, 1999

[54] COMBINED TOWING AND DOCKING HITCH FOR WATERCRAFT

[76] Inventor: Mark S. Patterson, 2525 Sabre Ct., Apt. B, Redding, Calif. 96002

[21] Appl. No.: 08/937,168

[22] Filed: Sep. 25, 1997

Related U.S. Application Data

[63] Continuation-in-part of application No. 29/052,388, Mar. 28, 1996, Pat. No. Des. 384,480.

[51] Int. Cl.[6] ..... B63B 21/58

[52] U.S. Cl. ..... 114/249; 114/258

[58] Field of Search ..... 114/258, 259, 114/263, 264, 265, 266, 242, 248, 249, 250, 253, 254, 230.15, 230.2, 230.23

[56] References Cited

U.S. PATENT DOCUMENTS

| | | | |
|---|---|---|---|
| 3,492,964 | 2/1970 | Garcia | 114/249 |
| 3,651,778 | 3/1972 | Derecktor | 114/250 |
| 3,892,195 | 7/1975 | Janssen . | |
| 4,407,214 | 10/1983 | Kawasaki . | |
| 4,947,779 | 8/1990 | Grinde . | |
| 5,354,222 | 10/1994 | Elias | 114/249 |
| 5,715,770 | 2/1998 | Heyworth | 114/258 |

FOREIGN PATENT DOCUMENTS 131283 1/1933 Australia .

*Primary Examiner*—Stephen Avila
*Attorney, Agent, or Firm*—Lothrop & West

[57] ABSTRACT

A combined towing and docking hitch for watercraft. The hitch includes an elongated frame with a cable winch, a rearward yoke subframe, and a forward coupler. The coupler is adapted for mating with a complementary receptacle or receiver, mounted either on the stern of a towing boat or a boat dock. A cable or fiber web extending from the winch is attached to the bow eye of the towed or docked watercraft. The cable is advanced forwardly to draw the bow into nested engagement with the yoke. The yoke includes a pair of rearwardly diverging stabilizer arms having resilient bumpers on each end. A V-shaped roller is provided adjacent the converging region of the arms to accommodate the front bow stem of the towed watercraaft. The frame is pivotally attached to the coupler to accommodate wave-induced pitching movement, between the two vessels or between the moored watercraft and the dock.

23 Claims, 8 Drawing Sheets

62
63
67
66
64
68
69
73
72
71
22
57
58
59
26
61
18
47
51
49
53
31
32
48
33
34
17
46
13

COMBINED TOWING AND DOCKING HITCH FOR WATERCRAFT

CROSS-REFERENCE TO RELATED APPLICATION

This application is a continuation-in-part of U.S. Ser. No. 29/052,388, filed Mar. 28, 1996 now U.S. Des. No. 384,480, issued Sep. 30, 1997.

BACKGROUND OF THE INVENTION

1. Field of the Invention

The invention relates generally to devices for towing and mooring watercraft and vessels. More particularly, the invention pertains to a boat hitch comprising a frame and a rearwardly extending yoke. The yoke in combination with an associated cable winch, are effective to engage and restrain the bow of a boat. A coupler on the front of the frame mates with a receiver, mounted either on a tow boat or a dock.

2. Description of Prior Art

House and patio boats are a convenient and pleasurable means for boating on lakes and other relatively calm bodies of water. Often, the users of house boats also tow smaller fishing or ski boats behind the house boat, to remote locations. This allows the user to enjoy the comfort of the house boat, while having a quicker and more maneuverable vessel on hand to participate in various water sports.

Ropes are typically used both for towing the smaller boats, and for tying the smaller boats along the side of an anchored house boat. As long as the smaller boat is under tow, the rope system works reasonably well. However, when the house boat slows down or stops, someone on the towing boat must run to the stem of the boat, to ensure that the smaller boats do not collide with each other or the stem of the house boat. This can be a dangerous procedure, particularly when the house boat must make a quick stop, or when the weather is inclement.

Wind and wave action can also cause problems for smaller boats tied to the side of the house boat. Differential movement of the vessels causes unexpected and unavoidable contact between them, sometimes resulting in damage to the boats and safety hazards to people.

The principal problem with towing or mooring a small boat with a rope is the inability to maintain complete control over the smaller boat. This problem is exacerbated during speed or direction changes, and during strong winds or rough water conditions. The need exists, then, for an apparatus to maintain a towed boat in total control, during all aspects of a towing operation. The need also exists for a boat hitch which is adaptable for towing boats having a wide range of sizes and hull characteristics. The need further exists for a single apparatus, which can be used both for boat towing, and for dock mooring, using a universal coupler which can mate both with a boat receiver and a dock receiver.

SUMMARY OF THE INVENTION

The apparatus of the present invention comprises a hitch for smaller watercraft, such as ski boats and fishing boats. The hitch is useful, both for towing and for mooring such craft. This dual-function is accomplished by means of a universal, vertical coupler, pivotally attached to the forward end of the main hitch frame. The coupler is adapted for mating with a receiver, mounted either to a towing boat or to a dock.

In a first embodiment of the invention, the main frame is constructed from a straight piece of tubing. A pivot attachment is provided at the forward end of the frame for connection to a vertical coupler. A yoke sub-frame has a forward portion adapted to slide within the rearward end of the frame, permitting fore and aft adjustment of the yoke. A locking pin secures the frame and the yoke together in a predetermined position. The yoke also includes rearwardly diverging stabilizer arms, configured to accommodate the forward, bow portion of a boat. Resilient, cylindrical bumpers are secured to the rearmost ends of the arms. A V-shaped rubber stopper is provided on the yoke between the arms.

The vertical coupler is secured within a receiver, mounted either on the stern of a towing boat, or on a dock. A pin is used to lock the coupler within the receiver at a predetermined height, so that the frame is generally in line with a bow eye on the boat.

A cable winch is mounted on the nether side of the frame. A hook on the end of the cable is attached to the bow eye. As the cable is drawn onto the winch reel, the bow of the boat is drawn snugly against the rubber stopper and the laterally positioned stabilizer arms.

A second embodiment of the invention shares many structural aspects of the first embodiment. However, several features of the first embodiment are modified, and other additional features are included: The forward portion of the frame displays a "gooseneck" configuration, allowing the height of the frame to be adjusted over a wider useful range; a clear plastic roller replaces the rubber stopper, eliminating black scuff marks on the bow of the boat, and providing lowered friction to vertical movement of the bow; the bumpers on the ends of the stabilizer bars are laterally adjustable, to accommodate boat bows of different breadths and configurations; the bumpers are mounted loosely on support axles, which allow the bumpers to wobble axially into flush engagement with the boat sidewalls; a second receiver construction is disclosed, which allows fore and aft adjustment of the frame, with respect to the stern of a boat, or the edge of a dock.

DETAILED DESCRIPTION OF THE PREFERRED EMBODIMENT

Figure 1:
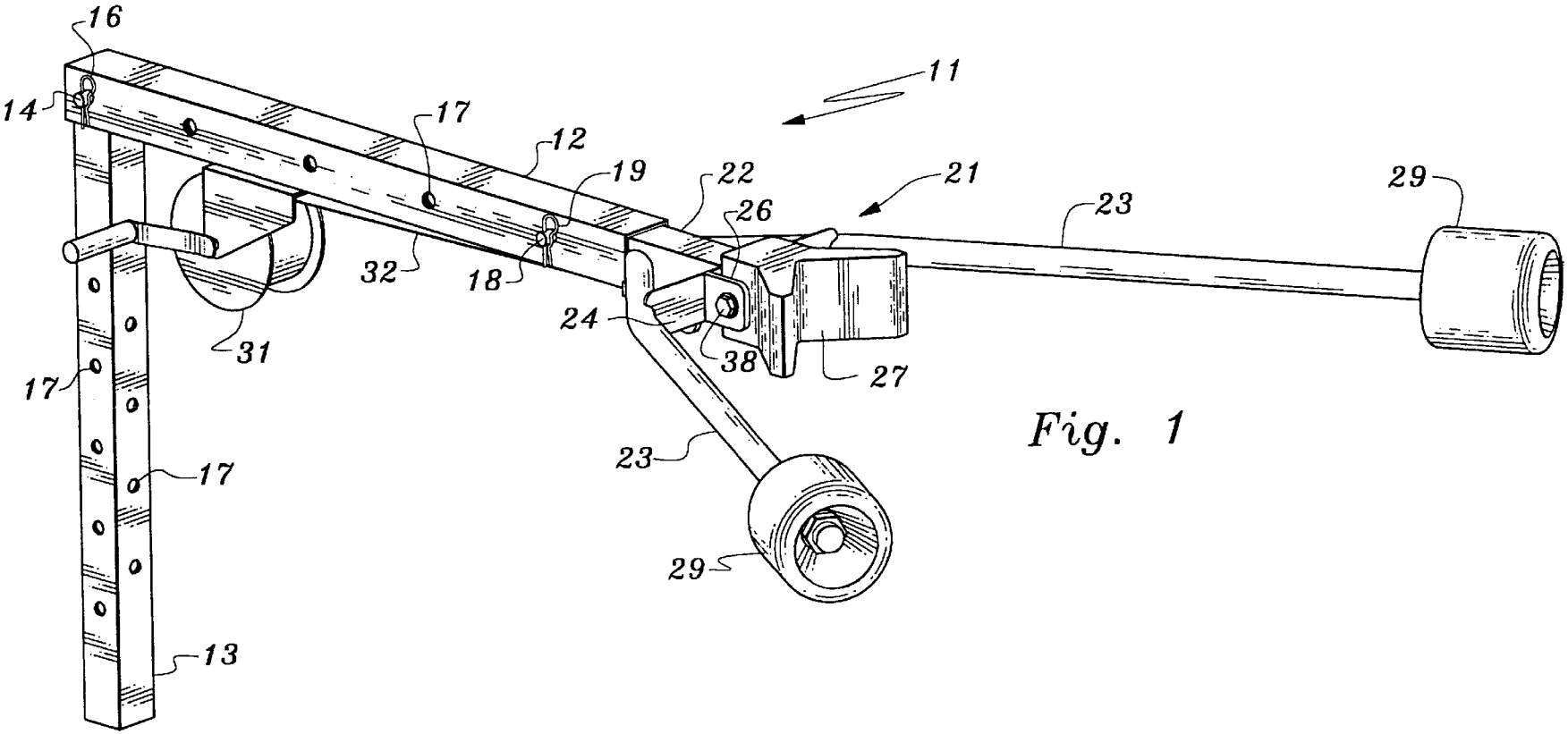
FIG. 1 is a right front perspective of a first embodiment of the combined towing and docking hitch.

Turning now to FIG. 1 of the drawings, a combined towing and docking hitch 11 is disclosed. Hitch 11 includes a frame 12, preferably constructed from a straight section of square tubing. A vertical coupler 13 is pivotally attached to a forward end of frame 12, by means of a pivot pin 14 and a cotter pin 16. Both frame 12 and coupler 13 include a plurality of transversely extending apertures 17, sized to accommodate locking pins 18 secured by cotter pins 19. Locking pins 18 are used for adjustably securing certain associated structures to frame 12 and coupler 13.

Figure 9:
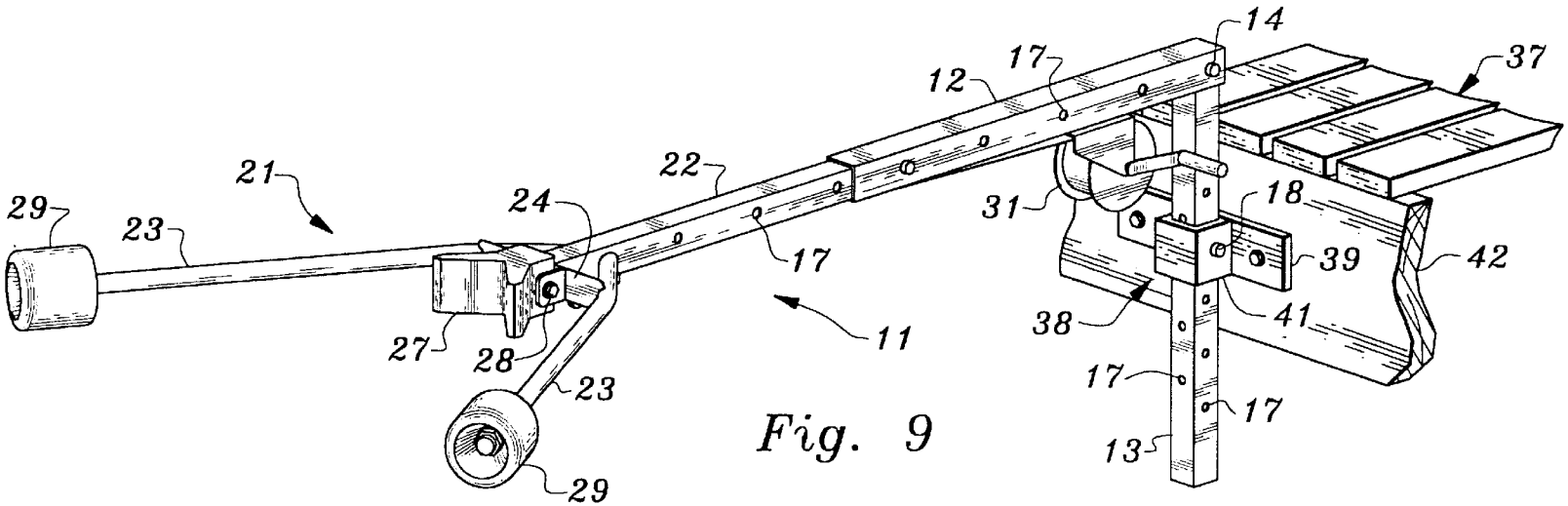
FIG. 9 is a left front perspective view, showing the hitch coupled to a receiver mounted on the side of a dock.

A yoke 21 includes a forward connector end 22, preferably constructed from square tubing sized to slide freely within the rear end of frame 12. Connector end 22 includes a plurality of apertures 17, spaced along its length. A comparison of FIGS. 1 and 9 reveals a range of fore and aft positions yoke 21 can assume. The user will select a particular position for the yoke, depending upon the size of the vessel, the structure to which the hitch is attached, the prevailing weather conditions, and the need for additional space between the structure and the vessel.

Figure 2:
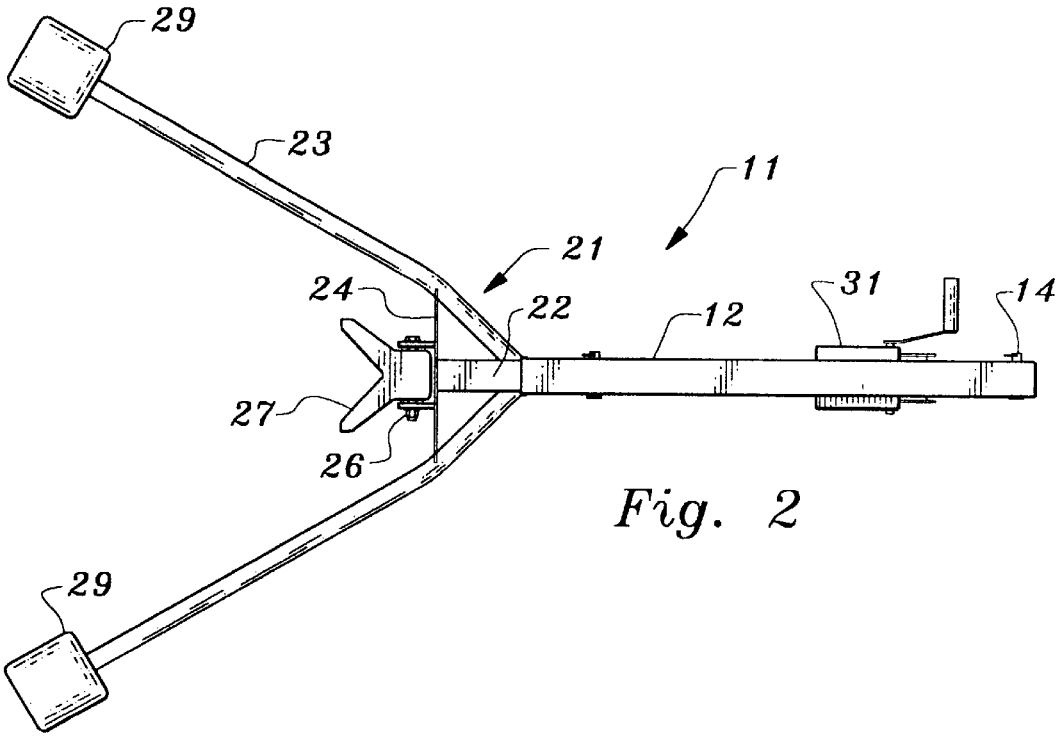
FIG. 2 is a top plan view.
Figure 3:
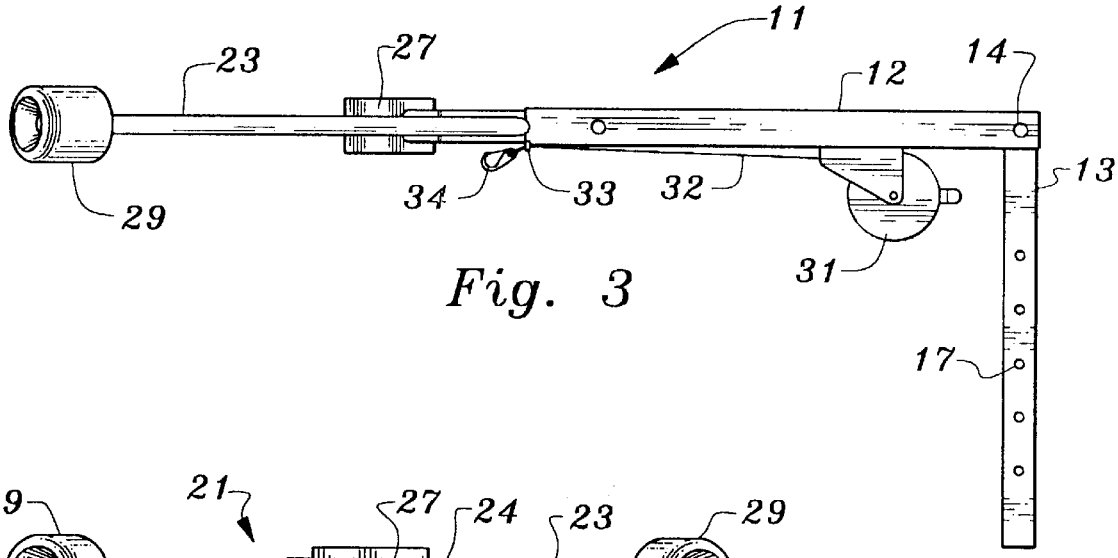
FIG. 3 is an elevational view of one side.
Figure 4:
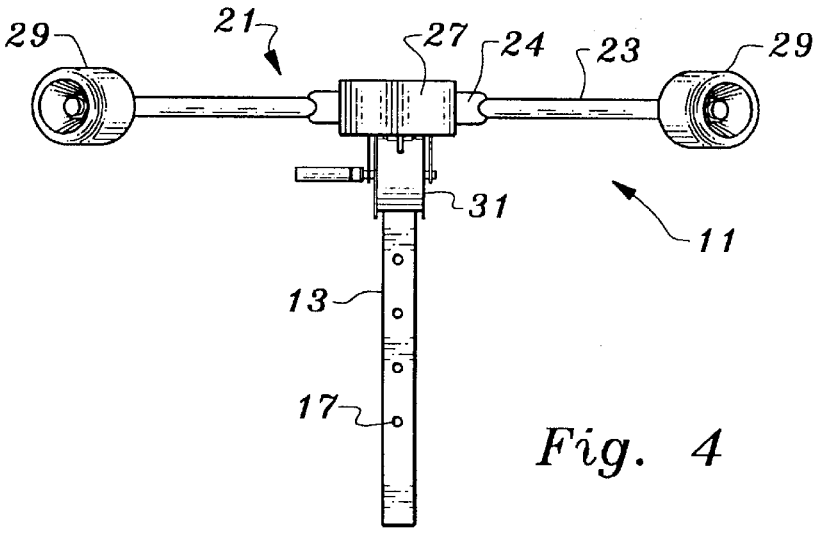
FIG. 4 is a rear elevational view.
Figure 5:
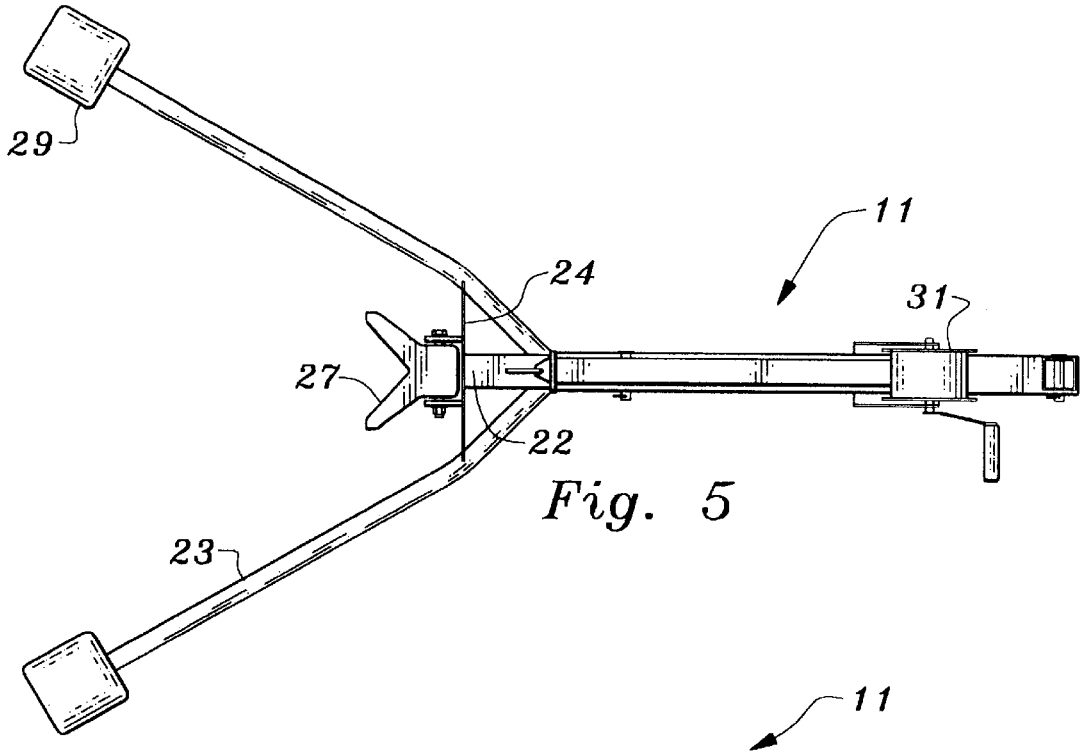
FIG. 5 is a bottom plan view.
Figure 6:
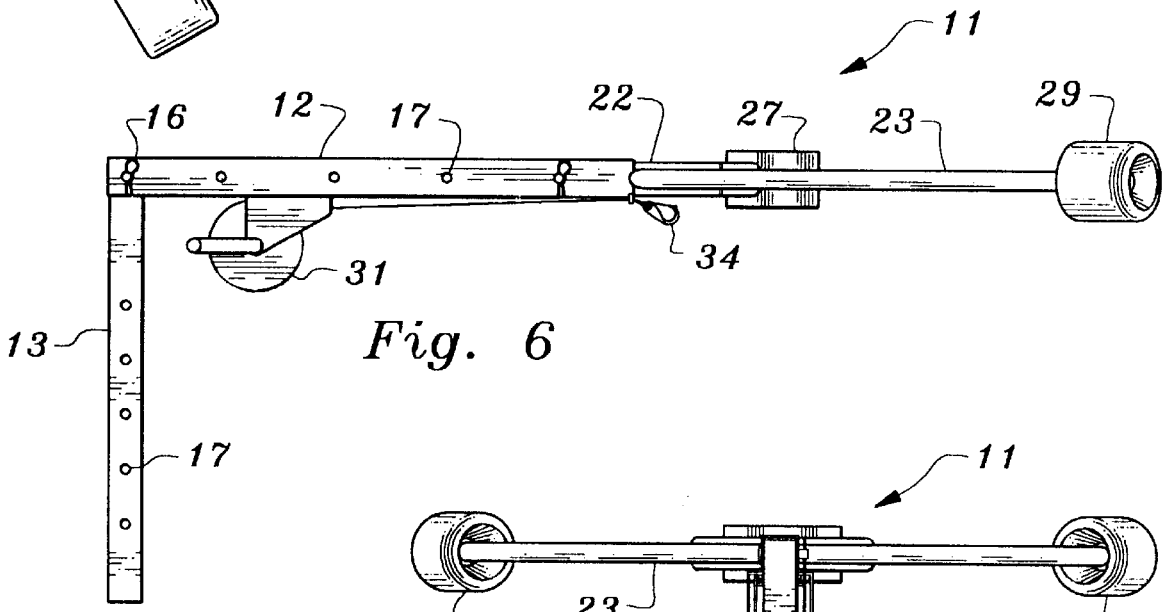
FIG. 6 is an elevational view of the other side.
Figure 7:
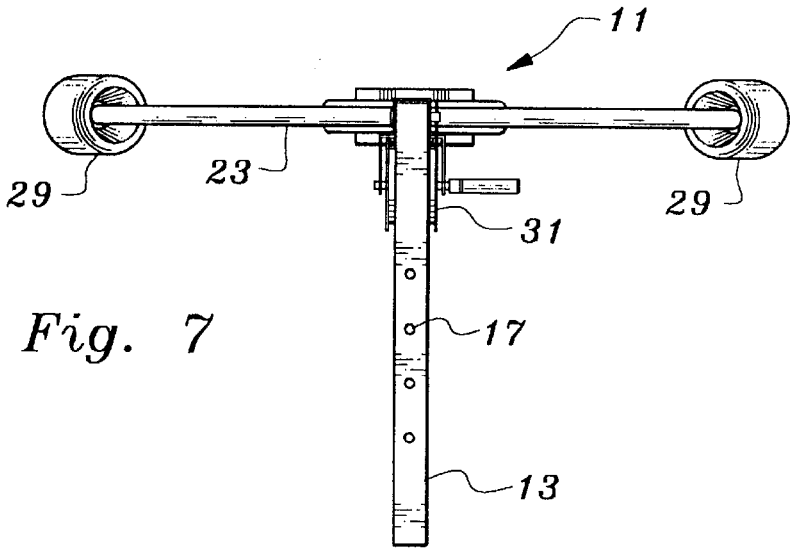
FIG. 7 is a front elevational view.

Extending rearwardly from connector end 22 is a pair of tubular stabilizer arms 23. Arms 23 are welded to respective sides of connector end 22, and secured to each other by a transverse brace 24. As shown in FIG. 2, the rear extremity of connector end 22 is also welded to brace 24 to provide additional rigidity to the assembly. A pair of brackets 26 extends rearwardly from brace 24. A V-shaped rubber stopper 27 is pivotally secured between brackets 26 with a bolt 28. Stabilizer arms 23 diverge rearwardly to form a bow docking structure, resembling the top plan profile of the bow portion of a vessel. Resilient cylindrical bumpers 29 are rotatably attached to each end of the stabilizer arms 23, to complete the yoke assembly 21.

A winch 31 is secured to the lower side of frame 12. A cable 32, or a nylon web line, extends from the winch, passes through a guide 33, and terminates in a hook 34. In a fully retracted position, hook 34 is secured against guide 33. In preparation for use, the locking mechanism of winch 31 is released, allowing the cable and hook to be pulled out the desired distance from hitch 11.

The hitch 11 may be attached either to a towing boat 36 or a dock 37. For that purpose, a receiver 38 is provided. Receiver 38 includes a base plate 39 and a square receiver tube 41. Plate 39 includes holes for bolt mounting, either to the stern of boat 36 or to a joist 42 of dock 37. Receiver tube 41 is vertically oriented, and sized to accommodate vertical coupler 13. A locking pin 18 passes both through tube 41 and through a selected pair of holes 17 within coupler 13. A pair of holes is selected, once the desired height and orientation of the hitch have been determined. It should be noted that pairs of holes 17 are provided along both opposing sides of coupler 13. This allows hitch 11 to be secured to the receiver in two ways: extending either perpendicular from or parallel to the stem of boat 36 or the side edge of dock 37.

Figure 8:
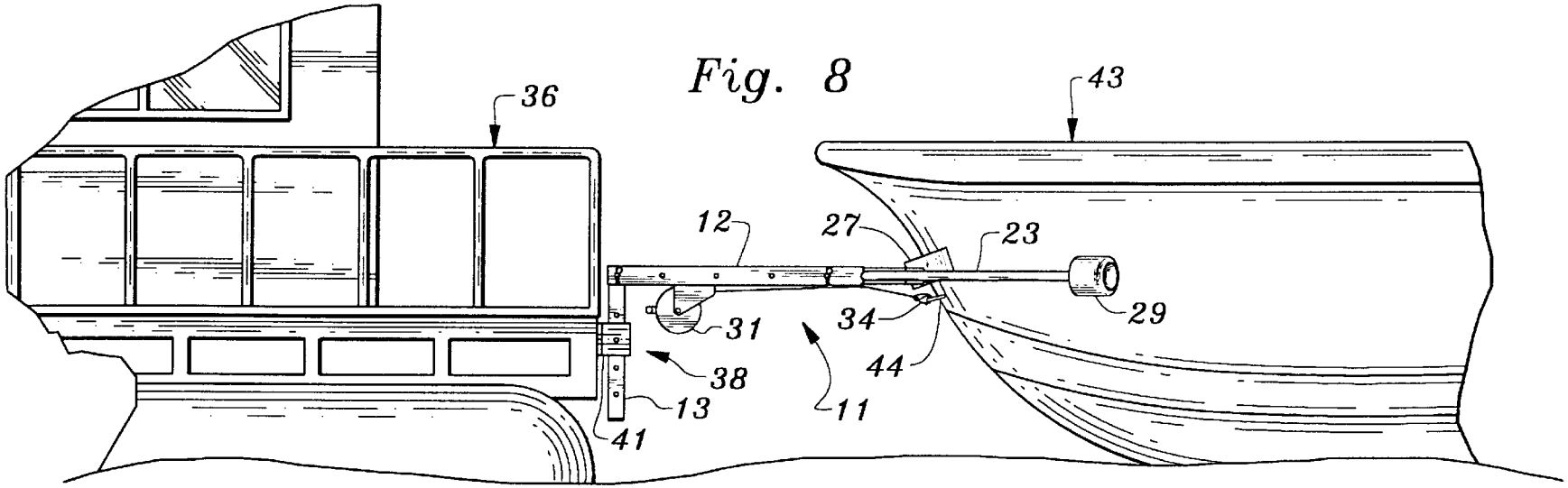
FIG. 8 is a side elevational view, showing the hitch engaging the bow of a towed boat, and coupled to a receiver mounted on a towing boat.

After the hitch has been secured within the receiver 38, the lock on the winch 31 is released, allowing the cable 32 and hook 34 to be drawn rearwardly, toward a towed boat 43. As shown in FIG. 8, boat 43 includes a bow eye 44, through which hook 34 is attached. If necessary, coupler 13 may be re-adjusted within receiver 38 at this time to ensure that eye 44 and frame 12 are in close axial alignment. As winch 31 is cranked, the towed boat 43 is slowly advanced into yoke 21, eventually coming into contact with stopper 27 and bumpers 29. Stopper 27 may pivot on its axis, to accommodate the inclination of the nose of the boat, as well as slight vertical movements of the boat 43. Pivot pin 14, at the juncture of frame 12 and coupler 13, accommodates larger pitching movements between towing boat 36 and towed boat 43.

During all aspects of towing operations, the hitch maintains total control over the towed boat 43. Accordingly, the towing boat 36 can undergo acceleration and deceleration, both forwardly and rearwardly, and take both left and right turns, and towed boat 43 simply mimics the same operations, keeping perfectly in step with the towing boat. No additional personnel is required, and no safety hazard is presented during speed, direction, or course changes made by the towing boat.

When the towing boat returns to the main dock 37, the towed boat can be moored by removing the coupler 13 from the receiver mounted on the stern of the towing boat, and inserting the coupler into the receiver mounted on the dock. Wave action and differential movement between the dock and the moored boat are accommodated by the pivot between frame 12 and coupler 13.

A second embodiment of the invention, combined towing and docking hitch 46, is disclosed in FIGS. 10–16. For brevity and clarity, the same numerical designations which were used in explaining the first embodiment will be used in the following discussion, to identify identical components. The hitch 46 includes a frame 47, having a horizontal, elongated rear section 48, a forwardly and upwardly inclined median section 49, and a horizontal, forward stub section 51.

This offset construction in the sections of frame 47, in effect, lowers the height of rear section 48 in relation to pivot pin 14. Thus, for a given vertical position of coupler 13, the rear portion of frame 47 is lower than the corresponding portion of frame 12 of the first embodiment. The advantage of this offset construction is that it enables the hitch 46, as a system, to engage bow eyes of towed boats more effectively than the hitch 11 of the first embodiment.

Figure 10:
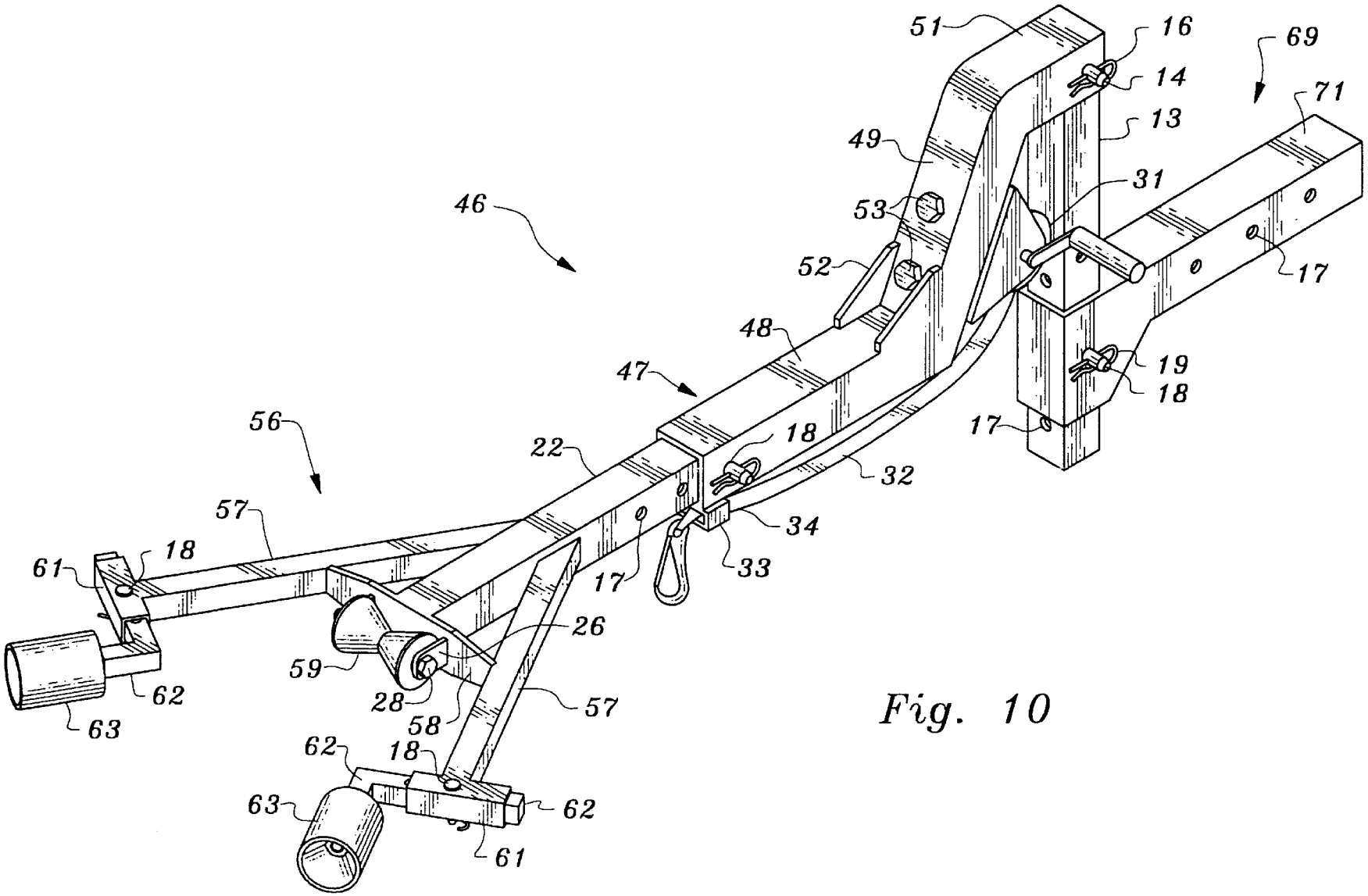
FIG. 10 is a left front perspective view of a second embodiment of the hitch, coupled to a portion of a receiver.

A pair of gusset plates 52 provides rigidity to the juncture between sections 48 and 49. A pair of bolts 53 and nuts 54 secures winch 31 to the underside of median section 49. Cable 32 passes through guide, dressing the cable along the underside of rear section 48. A hook 34 is included at the end extremity of cable 34. In its stored position, hook 34 is secured against guide 33, as shown in FIG. 10.

A yoke 56 includes a forward connector end 22, sized and configured to slide freely within the rear section 48 of frame 47. As with the first embodiment, the user will select a particular position for the yoke 56 with respect to the frame 47, depending upon the various parameters discussed above. A selected aperture 17 in combination with a locking pin 18, secures the yoke and frame assemblies together.

Extending rearwardly from connector end 22 is a pair of square, tubular stabilizer arms 57. As in the first embodiment, arms 57 are welded to respective sides of connector end 22, and secured to each other by a transverse brace 58. A pair of brackets 26 extends rearwardly from brace 58. A V-grooved guide roller 59 is pivotally secured between brackets 26 with a bolt 28.

Affixed transversely to the ends of the rearwardly diverging stabilizer arms, are respective tubular sleeves 61. An L-shaped roller arm 62 is slidable within sleeve 61. Arm 62 includes a plurality of apertures 17 along its length (see, FIG. 14), so that the user can secure arm 62 in the desired position. Resilient cylindrical bumpers 63 are attached to each end of a roller arm 62, so as to allow both rotation and wobble about a threaded axle 64 of arm 62.

Figures 11, 12, 13:
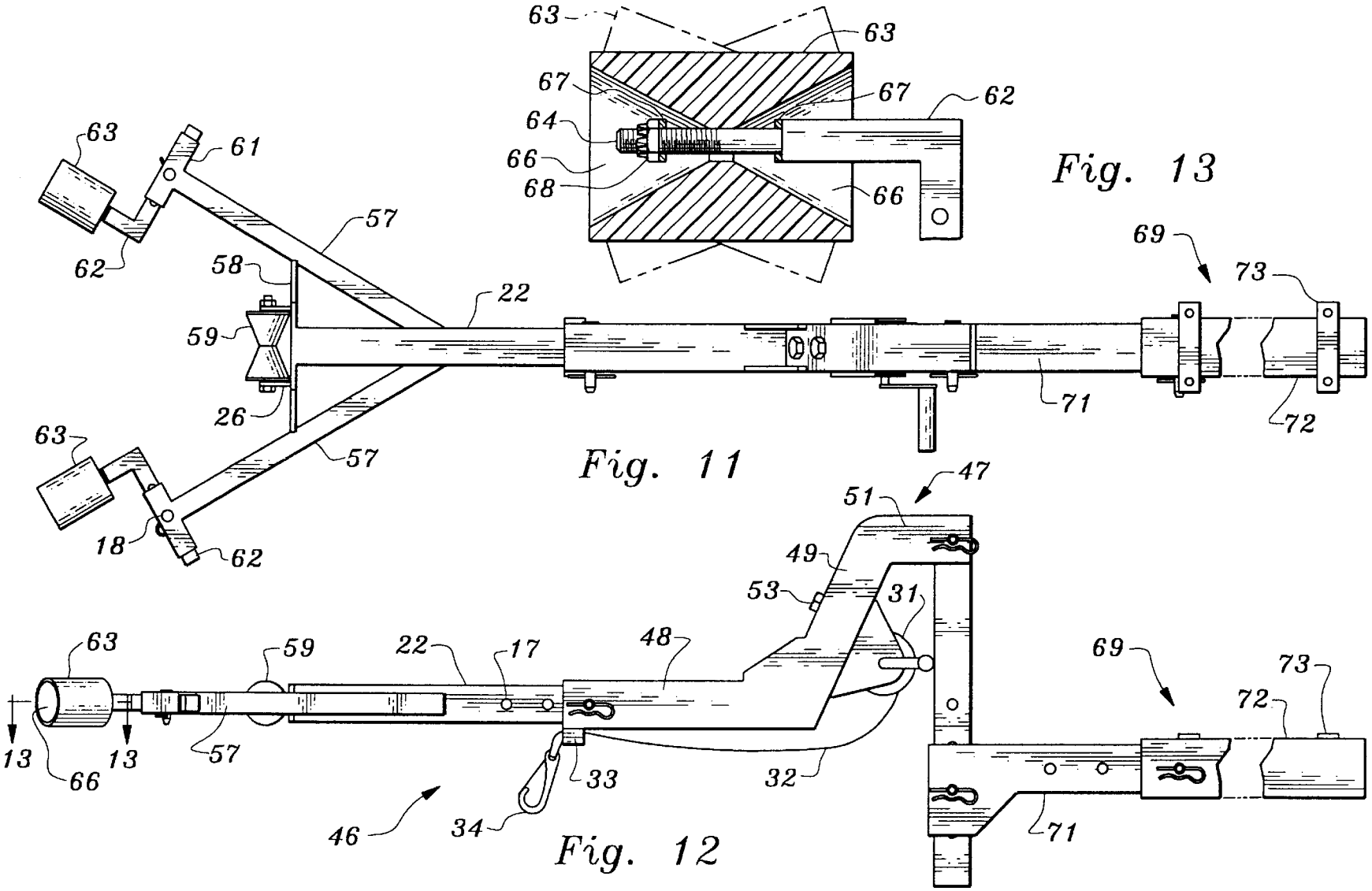
FIG. 11 is a top plan view of the second embodiment, showing a fragmentary portion of the receiver.
FIG. 12 is a side elevational view of the second embodiment, showing a fragmentary portion of the receiver.
FIG. 13 is a longitudinal, cross-sectional view of a stabilizer arm bumper.
Figure 14:
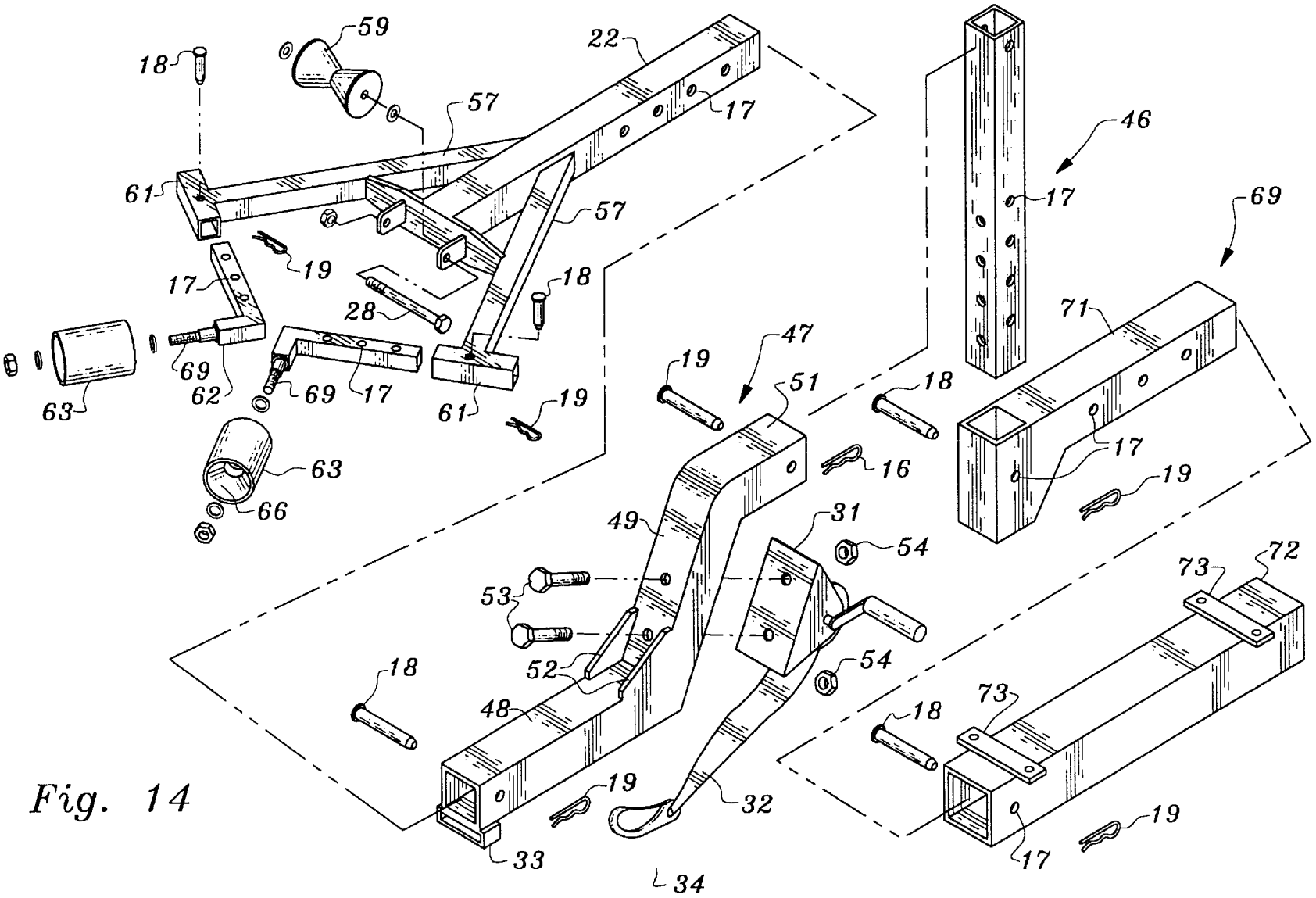
FIG. 14 is an exploded perspective view of the second embodiment and the entire receiver assembly.
Figure 15:
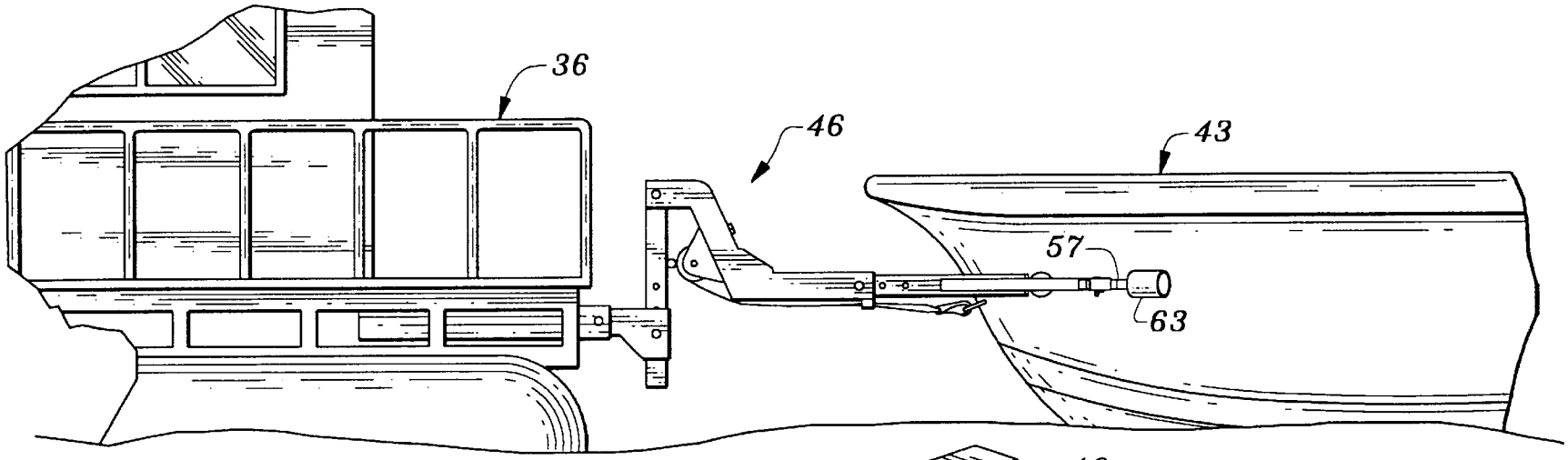
FIG. 15 is a side elevational view of the second embodiment, showing the hitch engaging the bow of a towed boat, and coupled to the receiver assembly mounted on a towing boat; and, FIG. 16 is a left front perspective view of the second embodiment, showing the hitch coupled to a receiver mounted on the side of a dock.
Figure 16:
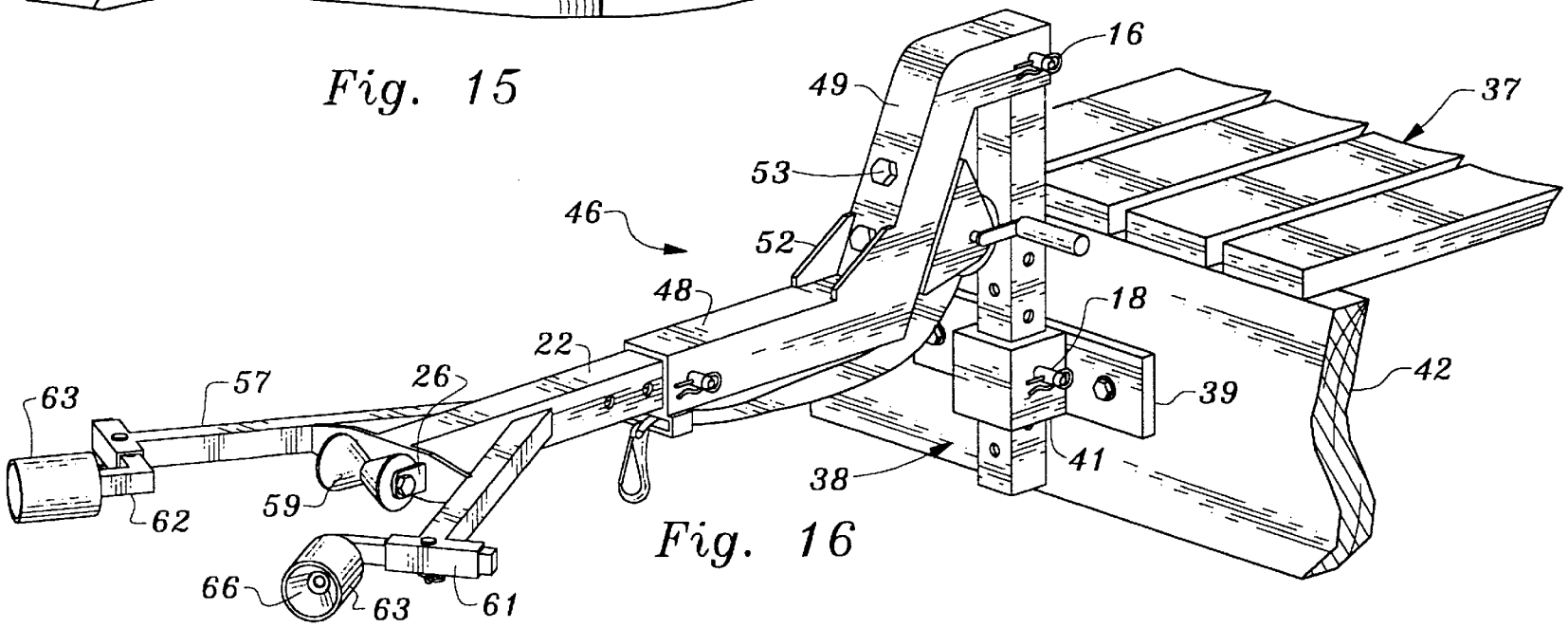

Making particular reference to FIG. 13, it will be noted that conical recesses 66 are located at both ends of bumper 63. These recesses are sized to allow the bumper to wobble, or cant, about the axis of axle 64. Two washers 67 are provided on axle 64, to protect the adjacent inner surface of the bumper. A self-locking nut 68, is loosely threaded over the after end of axle 64. The space tolerances between the axle, the washers, the nut, and the bumper are such that the bumper can freely rotate and cant, about and with respect to axle 64. Representative alternative positions for bumper 63, are shown in broken line in FIG. 13.

An adjustable receiver 69 is comprised of slidable portion 71 and fixed portion 72. Slidable portion 71 includes a plurality of apertures along its length for adjustment within fixed portion 72. A locking pin 18 and a cotter pin 19 are provided for securing the two portions together. A pair of mounting bars 73 is welded to the top of portion 72, for screw attachment to the underside of a towing boat or a dock. The principal advantage provided by the adjustable receiver, is the ability selectively to position the entire hitch assembly 46, with respect to the supporting boat or dock structure.

The operation of hitch 46 is very similar to that already explained, with respect to hitch 11. After the towed boat is drawn into yoke 56, the user may desire to make a further adjustment to the position of the bumpers 63. For example, the bumpers may be either too close or too far from the sides of the towed boat. If too close, the boat may be difficult to drawn into engagement with roller 59. If too loose, lack of control over the boat will result. As explained above, roller arm 62 is adjustable within sleeves 61, to effect lateral positioning of bumper 63 with respect to the axis of stabilizer arm 57. In this manner, the boat may snugly be secured within the confining components of yoke 56. Since the bumpers are free to rotate and cant, and the roller is free to rotate, a certain degree of controlled movement of the towed boat within the yoke is possible, in response to incoming waves. Also, the pivot attachment between frame 46 and coupler 13 accommodates pitching action, between the towing boat and the towed boat.

It will be appreciated, then, that I have described two embodiments of a combined towing and docking hitch for watercraft, which provide increased safety, reliability, and ease in the towing and mooring of vessels.

What is claimed is:

1. A combined towing and docking hitch for watercraft, comprising:

a. a frame having a forward end and a rearward end;

b. coupler means attached to said forward end of said frame, for detachably connecting said frame to a towing boat or a dock;

c. yoke means attached to said rearward end of said frame, for engaging both lateral portions and a forward end portion of the bow of a towed or docked watercraft; and, d. means attached to said frame, for drawing the towed or docked watercraft into a nested position within said yoke means, and restraining the watercraft therein.

2. An apparatus as in claim 1 in which said drawing means includes a cable winch.

3. An apparatus as in claim 1 in which said coupler means includes a tube having a vertical portion and a receiver attached to the towing boat or the dock, said receiver being sized and configured to receive said vertical portion in vertically slidable relation, and further including locking means to secure said vertical portion within said receiver at a predetermined height.

4. An apparatus as in claim 1 in which said yoke means includes at least two rearwardly diverging stabilizer arms.

5. An apparatus as in claim 4 in which said arms include resilient bumpers on respective ends thereof.

6. An apparatus as in claim 5 in which said bumpers are laterally adjustable with respect to an axis of each of said arms.

7. An apparatus as in claim 4 in which said yoke means further includes a guide roller, said roller being transversely positioned between said stabilizer arms and engageable with said forward end portion of the bow of the towed watercraft.

8. An apparatus as in claim 1 in which said coupler means is pivotally attached to said forward end of said frame.

9. An apparatus for towing and docking watercraft, comprising:

a. a frame, having a forward end and a rearward end;

b. a coupler attached to said forward end, said coupler being detachably connected to a receiver secured to a towing boat or a dock;

c. a yoke attached to said rearward end, for engaging both the lateral portions and a forward end portion of the bow of a towed or docked watercraft; and, d. a winch attached to said frame, said winch including a cable for attachment to the watercraft.

10. An apparatus as in claim 9 in which said coupler includes a tube having a vertical portion, said receiver being sized and configured to receive said vertical portion, and further including locking means to secure said vertical portion within said receiver at a predetermined height.

11. An apparatus as in claim 9 in which said receiver includes a slidable portion and a fixed portion, said fixed portion being attached to a towing boat or a dock, and said slidable portion being attached to said fixed portion and adjustable in relation thereto, for extension and retraction of said coupler in relation to the towing boat or the dock.

12. An apparatus as in claim 10 in which said locking means includes: a plurality of apertures extending along and transversely through said vertical portion; at least one bore within said receiver; and, a pin sized and configured to pass first through said bore and then through a selected one of said apertures.

13. An apparatus as in claim 9 in which said yoke includes at least two rearwardly diverging stabilizer arms.

14. An apparatus as in claim 13 in which said arms include resilient bumpers on respective ends thereof.

15. An apparatus as in claim 14 in which said bumpers are transversely adjustable with respect to a longitudinal axis of a respective said arm.

16. An apparatus as in claim 13 in which said yoke includes a guide roller, said roller being transversely positioned between said stabilizer arms and engageable with said forward end portion of the bow of the watercraft.

17. An apparatus for towing and docking watercraft comprising:

a. a frame having a horizontal rear section, a forwardly and upwardly inclined median section, and a horizontal forward stub section;

b. a coupler attached to said forward stub section, said coupler being detachably connected to a receiver secured to a towing boat or a dock;

c. a yoke attached to said rearward end, for engaging both the lateral portions and a forward end portion of the bow of a watercraft; and, d. a winch attached to said frame, said winch including a cable for attachment to the watercraft.

18. An apparatus as in claim 17 in which said coupler is pivotally attached to said forward stub section.

19. An apparatus as in claim 17 in which said receiver includes a slidable portion and a fixed portion, said fixed portion being attached to a towing boat or a dock, and said slidable portion being attached to said fixed portion and adjustable in relation thereto, for extension and retraction of said coupler in relation to the towing boat or the dock.

20. An apparatus as in claim 17 in which said yoke includes at least two rearwardly diverging stabilizer arms.

21. A combined towing and docking hitch for watercraft, comprising:

a. a frame having a forward end and a rearward end;

b. coupler means attached to said forward end of said frame for detachably connecting said frame to a towing boat or a dock, said coupler means including a tube having a vertical portion and a receiver attached to the towing boat or the dock, said receiver being sized and configured to receive said vertical portion in vertically slidable relation, and further including locking means to secure said vertical portion within said receiver at a predetermined height;

c. yoke means attached to said rearward end of said frame, for engaging both lateral and forward portions of the bow of a towed or docked watercraft; and, d. means attached to said frame, for drawing the towed or docked watercraft into a nested position within said yoke means, and restraining the watercraft therein.

22. A combined towing and docking hitch for watercraft, comprising:

a. a frame having a forward end and a rearward end;

b. coupler means attached to said forward end of said frame, for detachably connecting said frame to a towing boat or a dock;

c. yoke means attached to said rearward end of said frame, for engaging both lateral and forward portions of the bow of a towed or docked watercraft, said yoke means including at least two rearwardly diverging stabilizer arms having resilient bumpers on respective ends thereof, said bumpers being laterally adjustable with respect to an axis of each of said arms;

d. means attached to said frame, for drawing the towed or docked watercraft into a nested position within said yoke means, and restraining the watercraft therein.

23. An apparatus for towing and docking watercraft comprising:

a. a frame, having a forward end and a rearward end;

b. a coupler attached to said forward end and being detachably connected to a receiver secured to a towing boat or a dock, said coupler including a tube having a vertical portion and said receiver being sized and configured to receive said vertical portion;

c. locking means to secure said vertical portion of said coupler within said receiver at a predetermined height;

d. a yoke attached to said rearward end, for engaging both the lateral and the forward portions of the bow of a watercraft; and, e. a winch attached to said frame, said winch including a cable for attachment to the watercraft.

* * * * *